United States Patent [19]

Benko

[11] 4,446,197

[45] May 1, 1984

[54] ION BEAM DEPOSITION OR ETCHING RE RUBBER-METAL ADHESION

[75] Inventor: David A. Benko, Akron, Ohio

[73] Assignee: The Goodyear Tire & Rubber Company, Akron, Ohio

[21] Appl. No.: 401,201

[22] Filed: Jul. 23, 1982

[51] Int. Cl.[3] ..... B32B 15/06

[52] U.S. Cl. ..... 428/625; 428/469; 428/677; 204/192 C; 156/124; 152/359

[58] Field of Search ..... 428/625, 469, 677; 204/192 C; 156/124; 152/359

[56] References Cited

U.S. PATENT DOCUMENTS

| | | | |
|---|---|---|---|
| 3,809,635 | 5/1974 | Gillot et al. | 204/192 C |
| 4,101,402 | 7/1978 | Vossen, Jr. et al. | 204/192 C |
| 4,211,824 | 7/1980 | Yoshida | 428/469 |
| 4,218,517 | 8/1980 | Van Ooij | 428/625 |

OTHER PUBLICATIONS

Michael Mirtich, Adherence of Ion Beam Sputtered Deposited Metal Films on H-13 Steel, NASA Lewis Research Center, 1980, pp. 14–17.

C. Weissmantel et al., Surface Science, 86, 1979, pp. 207–210.

W. Hudson et al., NASA Techn. Mem. X-73598, Lewis Research Center, Feb. 14–16, 1977, 6th Ann. Symp. Appl. Vac. Sci. Tech. pp. 1–3.

J. S. Sovey, J. Vac. Sci. Techn. 16, No. 2, Mar.–Apr., 1979, pp. 813–814.

S. M. Kane et al., J. Vac. Sci. Tech. 16 (2) Mar./Apr. 1979, pp. 171–172.

"Advances in Low-Energy Ion Beam Technology," W. Laznovsky, Research and Development, Aug. 1975, pp. 47–55.

"Ion Beam Techniques for Thin and Thick Film Deposition," C. Weissmantel, H. Erler, and G. Reisse, Surface Science 86 (1979), pp. 207–210.

"Ion Beam Texturing," by Wayne Hudson, Published in Journal of Society Technology, vol. 14, No. 1, Jan. and Feb., 1977, pp. 286–287.

"Optical Properties of Ion Beam Textured Materials" by Hudson, Weigand and Mirtich, Feb. 14–16, 1977.

"Ion Beam Sputtering of Fluoropolymers," by Sovey, published in Journal of Vacuum Science and Technology, Mar.–Apr, 1979.

"Characteristics of Ion-Beam-Sputtered Thin Films" by Kane and Ahn of IBM, published in the Journal of Vacuum Science and Technology, Mar.–Apr., 1979, pp. 171–172.

*Primary Examiner*—Veronica O'Keefe

*Attorney, Agent, or Firm*—Daniel J. Hudak; Henry C. Young, Jr.

[57] ABSTRACT

Metal to rubber adhesion is improved by metal substrates having a coating thereon such as brass, copper, and the like. The coating is applied by an ion beam sputter deposition or, in the alternative, such a coating is partially removed through ion beam etching. The present invention is particularly useful in tire cord construction, metal reinforced belts and hoses, and the like, since articles made therefrom have superior and unexpected moisture aged rubber-to-metal adhesion properties.

11 Claims, No Drawings

ION BEAM DEPOSITION OR ETCHING RE RUBBER-METAL ADHESION

BACKGROUND ART

The present invention relates to unexpected rubber-metal adhesion improvement for metal substrates which were prepared using ion beam etching and deposition.

Heretofore, wire used as reinforcement in rubber articles has been manufactured by coating the wire wth a non-ferrous metal using conventional electroplating techniques. The coating material can consist, for example, of a layer of a brass alloy which is often used for the purpose mentioned. The specific composition and thickness of the coating material of the wire are restricted by manufacturing considerations. For example, a brass alloy coated on a reinforcing wire must contain at least 63 percent copper and be at least 1000 Å thick.

It has been observed that moisture is generally very harmful for the adhesion between the steel reinforcement and the rubber article. For example, U.S. Pat. No. 3,749,558 notes that copper-plated steel wires display considerably higher adhesion failures after exposure to a 60 percent relative humidity environment than when exposed to a dry air environment. This has been of particular concern in recent years in which a strong demand is made of the safety and waterproofness of wire reinforced tires.

A number of methods have been described that prevent loss of rubber adhesion to conventionally prepared wires after moisture exposure. For example, U.S. Pat. No. 3,846,160 claims a process whereby the steel wire coated with brass alloy is immersed in a mineral oil solution prior to vulcanization. Another solution to the moisture problem calls for the use of a low copper content brass alloy as described in British Pat. No. 1,250,419. A third method to prevent adhesive degradation under corrosive conditions involves the use of ternary brass alloys containing copper, zinc, and cobalt as described in British Pat. Nos. 2,011,501A and 2,306,278. Finally, U.S. Pat. No. 3,749,558 describes the use of copper-nickel and copper-zinc-nickel alloy coatings on wire to prevent adhesion loss.

However, none of these patents relate to the use of ion beam deposition or etching or to improved rubber moisture age adhesion.

Ion beam sputter deposition and etching are relatively new techniques. For example, in an article "Adherence of Ion Beam Sputtered Deposited Metal Films on H-13 Steel" by Michael Mirtich, Lewis Research Center, prepared for the 27th National American Vacuum Society Symposium, Detroit, Mich., Oct. 14–17, 1980, it is noted that die life can be increased by sputter depositing molybdenum or chromium upon a casting die. Moreover, the tables set forth various other materials and the adherence thereof to a steel substrate.

In an article entitled "Advances in Low-Energy Ion Beam Technology," by W. Laznovsky, Research and Development, August 1975, pages 47–55, ion beams have been set forth as having been utilized for the etching of microcircuits, surface wave device contacts, and the like, in essence, whenever high resolution (in the submicrometer range) is required.

"Ion Beam Techniques for Thin and Thick Film Deposition," by C. Weissmantel, H. Erler, and G. Reisse, Surface Science 86 (1979), North-Holland Publishing Company, pages 207–210, relates to various techniques for sputtered depositing films of various metals or alloys.

An article entitled "Ion Beam Texturing" by Wayne Hudson of the NASA, Lewis Research Center, Cleveland, Ohio, published in the Journal of Vacuum Society Technology, in Volume 14, No. 1, January and February 1977, pages 286–287, relates to the use of texturing many surfaces such as stainless steel, titanium, aluminum, copper and silicon by ion beam sputtering in an attempt to provide a suitable optical coating.

In Optical Properties of Ion Beam Textured Materials by Hudson, Weigand, and Mirtich, Lewis Research Center, in a paper presented to the Sixth Annual Symposium on Applied Vacuum Science and Technology, Tampa, Fla., Feb. 14–16, 1977, ion beams are used to coat a solar apparatus.

In an article entitled "Ion Beam Sputtering of Fluoropolymers" by Sovey, NASA Lewis Research Center, Cleveland, Ohio, published in the Journal of Vacuum Science and Technology, March–April, 1979, the etching and deposition of fluoropolymers is described.

Finally, the article entitled "Characteristics of Ion-Beam-Sputtered Thin Films," by Kane and Ahn of IBM, published in the Journal of Vacuum Science and Technology, March–April, 1979, pages 171–172, relates to the thin films of various metals which have been prepared by ion beams sputtering with such films having excellent adhesion to a metal substrate.

Although the preceding representative articles describe ion beam sputtering or etching techniques, none relate to or even teach or suggest that adhesion of rubber to copper or brass-coated metals, such as those used in tire cord construction, rubber hoses, and with regard to any wire reinforced rubber article, would be improved.

DISCLOSURE OF INVENTION

It is therefore an aspect of the present invention to provide improved rubber-to-metal adhesion.

It is yet another aspect of the present invention to provide improved rubber-to-metal adhesion, as above, with regard to any metal reinforced rubber article.

It is yet another aspect of the present invention to provide improved rubber-to-metal adhesion, as above, wherein ion beam sputter deposition or etching is utilized to either apply a metallic coating or to remove a portion of a coating.

It is yet another aspect of the present invention to provide improved rubber-to-metal adhesion, as above, wherein various metals such as copper and/or zinc are utilized as the coating on the metal substrate.

It is yet another aspect of the present invention to provide improved rubber-to-metal adhesion, as above, wherein the coating is from about 5.0 to about 4,000 angstroms in thickness.

It is yet another aspect of the present invention to provide improved rubber-to-metal adhesion, as above, wherein superior rubber-to-metal long term moisture aging is achieved.

It is yet another aspect of the present invention to provide improved rubber-to-metal adhesion, as above, wherein said metal substrate can be in the form of wire and the like and exists as a tire cord.

It is yet another aspect of the present invention to provide improved rubber-to-metal adhesion, as above, including a process for preparing any of the above noted items of achieving metal-to-rubber adhesion.

These and other aspects or forms of the invention will become apparent from the following detailed specification.

In general, a process for preparing a metal surface for adhesion to rubber, comprises the steps of: applying an ion beam sputter deposition metal to a metal substrate, applying said deposition metal to said metal substrate until a coating of from about 5 to about 4,000 angstrom units is obtained and forming the metal surface, and wherein said deposition metal is selected from the group consisting of steel, zinc, copper, iron, nickel, aluminum, cobalt, and alloys thereof including brass.

Additionally, a process for preparing a metal surface for adhesion to rubber, comprises the steps of: sputter etching with an ion beam a coated metal surface, etching said surface so that a coating of from about 5 to about 4,000 angstrom units is obtained, and wherein said coating surface is selected from the group consisting of steel, zinc, copper, brass, iron, nickel, aluminum, cobalt, and alloys thereof including brass.

In general, a metal item having rubber adhered to a surface thereof, comprises: the metal item, said metal surface treated by an ion beam sputter deposition metal or sputter etching; the rubber adhered to said treated metal surface.

BEST MODE FOR CARRYING OUT THE INVENTION

In the production of rubber articles such as hose, pneumatic tires or power transmission belts such as V-belts, toothed positive drive belts, etc., it is generally necessary to reinforce the rubber or elastomeric product. In the past, textile materials have been employed for this purpose. However, wire cord has been found to be more desirable under certain conditions of use, for example, in pneumatic tires of the radial ply type. Maximum reinforcement of the rubber is obtained when maximum adhesion is produced and retained between the laminate of rubber and the metal reinforcing element as used to form a unitary structure. Of equal importance is the requirement that, for example, the laminate of the reinforcing metal element and rubber remain in a bonded relationship with each other throughout the useful life of the reinforced structure in which the laminate is used.

It has now been found that improved rubber-to-metal adhesion is achieved by applying or directing an ion beam onto a metal surface to which rubber is to be adhered. Generally, any metal substrate can be utilized to which rubber is to be adhered including iron, nickel, aluminum, and the like, with steel being the preferred substrate. The metal substrate can generally be in any form such as tire cords, tire beads, reinforcing material in conveyor belts, reinforcing material in hoses, belts, and the like. To improve adhesion of the rubber to a metal, the substrate preferably has a metallic coating thereon. Examples of coating metals, or substrate metals if no coating metals are utilized, include iron, steel, zinc, copper, nickel, aluminum, cobalt, and alloys thereof such as brass, with brass or copper being preferred. By brass, it is meant essentially a copper-zinc alloy containing from about 60 percent to about 75 percent by weight of copper and accordingly from about 25 to about 40 percent by weight of zinc. A desired amount of copper ranges from about 60 to about 70 percent by weight.

The ion beam is utilized in one of two manners in which to produce a desired finish or treatment upon the metal. The first procedure relates to ion beam sputter deposition, that is wherein the ion beam is directed upon a metallic target such as copper or zinc and then the ions formed thereof directed to the substrate to be treated. In this embodiment, the thickness of the coating applied can range up to about 4,000 angstroms, as from about 5 angstroms, desirably from about 200 to about 2,000 angstroms and preferably from about 500 to about 1,000 angstroms.

The second ion beam treatment relates to an etching of the metallic article. That is, in this treatment or process, a coating or the surface of the metallic item is actually removed. Thus, a metallic substrate is generally coated with any of the above metals in any conventional manner as by electroplating, electroless plating, and the like. The ion beam is then directed onto the substrate and utilized to partially remove a portion of the coating or to etch it. The application is continued until a desired surface is obtained. The coating can be continuous or discontinuous as when a specific pattern or design is made, as for example using an obstruction to mask part of the ion beam. The thickness of the remaining coating can be the same as set forth above.

It is understood that the temperature "ion beam" does not relate to conventional plasma deposition processes such as RF sputtering or electron-beam evaporation. An ion beam deposition or etch relates to a narrow beam directed at a specific target, be it the coating material or the object to be etched. Furthermore, the ion beam technique offers several advantages over the conventional plasma treatments.

These include better adhesion of the target to the substrate, purer deposits with fewer gas inclusions, minimal substrate heating and a larger variety of target materials that can be ion-beam sputtered.

The preparation of an ion beam or use thereof can be in accordance with any known structure of technique such as those set forth in the literature. Of course, to apply a continuous coating or etching, the substrate or article can be moved back and forth, rotated, or the like, such that a consistent or uniform ion beam treatment thereof is made. The literature which is hereby fully incorporated by reference with regard to utilizing an ion beam deposition or etching technique is as follows:

"Adherence of Ion Beam Sputtered Deposited Metal Films on H-13 Steel" by Michael Mirtich, Lewis Research Center prepared for the 27th National American Vacuum Society Symposium, Detroit, Mich., October 14–17, 1980;

"Advances in Low-Energy Ion Beam Technology," by W. Laznovsky, published in Research and Development, August 1975, pages 47–55;

"Ion Beam Techniques for Thin and Thick Film Deposition," by C. Weissmantel, H. Erler, and G. Reisse, Surface Science 86 (1979), North-Holland Publishing Company, pages 207–210;

"Ion Beam Texturing" by Wayne Hudson of the NASA Lewis Research Center, Cleveland, Ohio, published in the Journal of Vacuum Technology, Volume 14, No. 1, January and February 1977, pages 286–287;

"Optical Properties of Ion Beam Textured Materials" by Hudson, Weigand, and Mirtich, Lewis Research Center, in paper presented to the Sixth Annual Symposium on Applied Vacuum Science and Technology, Tampa, Fla., Feb. 14–16, 1977;

"Ion Beam Sputtering of Flouropolymers" by Sovey, NASA Lewis Research Center, Cleveland, Ohio, published in the Journal of Vacuum Science and Technology, March–April, 1979, pages 813–814; and "Characterisics of Ion-Beam-Sputtered Thin Films," by Kane and Ahn of IBM, published in the Journal of Vacuum Science and Technology, March–April, 1979, pages 171–172.

With regard to improved rubber adhesion, the ion beam is generally from an argon source. In general, the ion beam diameter can range from about 1 to about 30 centimeters with a diameter of from about 3 to about 30 centimeters being preferred. The ion source can operate at beam energies of from about 100 to about 2,000 electron volts with from about 500 to about 1,500 electron volts being preferred. Beam current density can range up to 2 milliamperes per cubic centimeter with about 0.5 milliampere per cubic centimeter to 1.0 milliaperes per cubic centimeter being preferred. Examples of a specific ion beam machine includes those mde by Veeco Industries, Inc., such as Model No. 3" Microetch 17471 equipped with Model No. 0313-060-00 ion beam deposition assembly.

In the use of an ion beam deposition procedure, the argon ions are generally directed upon a target so that the target material is released and directed through the use of focusing devices to the metal to be coated, be it a wire, a plate, or the like.

With regard to the etching treatment, a previously coated article is inserted in the path of the ion beam and rotated or moved until a desirable amount of the coating is removed. In general, the rate of removal and resulting surface texture is determined by the ion beam energy and current density and by the angle with which the ion beam strikes the coated article. In addition, masking devices may be placed in the path of the ion beam prior to striking the coated article such that a pattern is etched into the remaining coating.

The present invention relates to the use of any common or conventional type of rubber or elastomer which is readily available or known to those skilled in the art. Generally, the rubber can be made from dienes having from 4 to 12 carbon atoms or from multiple dienes such that copolymers terpolymers, etc. thereof are made. Additionally, another class of rubber compounds includes those made from the reaction of dienes having from 4 to 12 carbon atoms with a vinyl substituted aromatic compound having from 8 to 12 carbon atoms. A typical example is styrene-butadiene copolymer. Still other rubbers include nitrile rubber, polychloroprene, ethylene-propylene-diene rubber (EPDM), and the like. A preferred class of rubber compounds include cis-1,4-polyisoprene, either synthetic or natural, polybutadiene, the copolymer of styrene-butadiene, and the like. With regard to the rubbers, they are prepared in conventional and well known manners and thus have conventional amounts of various additives therein such as fillers, e.g., carbon black, accelerators, curing agents, stabilizers such as antioxidants, resins, metal salts, and the like. Such rubber compounds, as noted, are well known to the rubber industry and are conventional. The rubber compound or elastomer is made up according to any conventional manner and then applied in a conventional manner to the steel item or substrate, be it a tire cord, reinforcement for a conveyor belt or hose, or the like.

It has been unexpectedly found that the ion beam-treated metal yields greatly improved rubber adhesion and improved moisture aged adhesion thereto as to untreated surfaces.

Specific uses for the present invention include the application of rubber to tire cord, wherein the tires can be passenger tires, off-the-road tires, truck tires, and the like. Another utility of the present invention relates to metal wire reinforced rubber such as belts, hoses, conveyor belts, and the like. In fact, the present invention relates to any wire rubber reinforced article.

The invention will be better understood by reference to the following examples.

EXAMPLE 1

A. Test Sample Preparation:

The composition of the rubber compound used for wire adhesion testing is described in Table I. This composition was prepared by mixing the rubber in a Banbury with carbon black and other ingredients as specified in Table I. Sulfur, accelerator, and the cobalt carboxylate were then milled into the black stock. The resulting composition was sheeted out to 0.80 centimeters for use in fabrication of wire adhesion test pieces.

Adhesion was evaluated using the Tire Cord Adhesion Test (TCAT). Samples were prepared and tested according to the procedures described by A. W. Nicholson, D. I. Livingston, and G. S. Fielding-Russell, *Tire Science and Technology* (1978) 6, 114; G. S. Fielding-Russell and D. I. Livingston, *Rubber Chemistry and Technology* (1980) 53, 950; and R. L. Rongone, D. W. Nicholson and R. E. Payne, U.S. Pat. No. 4,095,465 (June 20, 1978).

Test samples were cured 56 minutes at 135° C. Adhesion tests were performed within 24 hours after curing and after aging by submersion in 90° C. water.

TABLE I

| Rubber Composition | | |
|---|---|---|
| INGREDIENT | PARTS BY WEIGHT | |
| cis-1,4-polyisoprene | 100.00 | Banbury Mix |
| peptizer | 0.05 | |
| carbon black | 57.00 | |
| stearic acid | 2.00 | |
| zinc oxide | 8.00 | |
| antioxidant | 0.75 | |
| cobalt salt of monocarboxylic acid (10 percent cobalt) | 1.50 | Mill mix |
| sulfur (80 percent active) | 5.00 | |
| sulfenamide accelerator | 0.65 | |

B. Wire Preparation:

Three 30 centimeter sections of 0.10 centimeter diameter steel wires containing 3,000 angstrom brass (66 percent copper, 34 percent zinc) coatings were rotated in the path of a 10 centimeter argon ion beam. The ion energy and current density were adjusted such that after 10 minutes, 500 angstroms of the original coating remained. A pressure of $3.9\times10^{-2}$ Pa was maintained in the vacuum chamber at all times during the etching. Sections of 6.3 centimeter length were cut from each treated wire and used to prepare the adhesion test samples. Table II compares the adhesion thus obtained with the ion beam etched wires to those obtained with untreated wire. The numbers in the table represent the average of two test values.

From the adhesion data, it can be seen that the ion beam etched wire displayed a substantial advantage in aged adhesion over the untreated brass wire.

TABLE II

| Adhesion Data From Ion Beam Etched Wire | | | |
|---|---|---|---|
| WIRE SURFACE | ORIGINAL TCAT ADHESION (NEWTONS) | TCAT ADHESION (N) AFTER AGING 7 DAYS IN 90° C. $H_2O$ | TCAT ADHESION (N) AFTER AGING 15 DAYS IN 90° C. $H_2O$ |
| 3,000Å electroplated brass (control) | 354 | 156 | 99 |
| 500Å etched brass | 276 | 206 | 172 |

TABLE III

| Adhesion Data from Ion Beam Sputter Deposited Wire | | | |
|---|---|---|---|
| 3,000Å electroplated brass (control) | 354 | 156 | 99 |
| 600Å sputter deposited copper | 254 | 267 | 205 |
| steel (control) | 159 | 153 | 151 |

EXAMPLE 2

A copper disk, 13 centimeters in diameter, was placed in the path of a 10 centimeter argon ion beam and cleaned for 0.5 hour using a beam energy of 1,000 eV. and a current density of 2 mA/cm$^2$. Three 30 centimeter sections of of 0.10 centimeter steel wires were inserted into the vacuum chamber and rotated in the ion beam for 0.5 hour using the above conditions.

The ion beam was then directed onto the copper target such that copper was removed and redeposited on the steel wire. This was continued until a 600 angstrom coating of copper had deposited on the wire.

Test pieces were prepared and tested as described in Example 1. Table III compares the adhesion for the ion beam plated wire with that from an electroplated brass wire and the bare steel wire. It can be seen that the sputter deposited copper-plated displayed an improvement in adhesion over the steel wire and an improvement in aged adhesion over the electroplated brass wire.

EXAMPLE 3

Following the procedures in Example 1, three 30 centimeter sections of 4×0.22 millimeter brass (63 percent copper, 37 percent zinc) plated steel wire cables were rotated in a 10 centimeter argon ion beam source. The original brass plating of 2,200 angstroms was etched to 500 angstroms. Table IV compares the adhesion values for the etched wire with those for the untreated wire. It can be seen that improved aged adhesion was obtained with the etched wire.

TABLE IV

| Adhesion Data for Etched Wire | | | |
|---|---|---|---|
| Wire Surface | Original TCAT Adhesion (N) | TCAT Adhesion (N) After Aging 7 days in 90° C. $H_2O$ | TCAT Adhesion (N) After Aging 15 days in 90° C. $H_2O$ |
| 2200Å electroplated brass (control) | 240 | 116 | 67 |
| 500Å etched brass | 185 | 138 | 133 |

TABLE V

| Adhesion Data for Sputter Deposited Wire | | | |
|---|---|---|---|
| Bare steel (control) | 87 | 71 | 69 |
| 2200Å electroplated brass (63% copper) (control) | 240 | 116 | 67 |
| 500Å sputter deposited copper | 178 | 149 | 138 |

EXAMPLE 4

Following the procedures of Example 2, three 30 centimeter sections of steel 4×0.25 millimeter wire cables were coated using sputter deposition with 500 angstroms of copper. Table V compares the adhesion values for the sputter deposited wire with those for the base steel wire and electroplated brass wire. It can be seen that the sputter deposited wire gave improved adhesion over the steel wire and improved aged adhesion over the electroplated brass wire.

Having described the best mode and preferred embodiments of the invention in detail, in accordance with the patent statutes, the scope of the invention is measured by the scope of the attached claims.

What is claimed is:

1. A metal item having rubber adhered to a surface thereof, comprising:

the metal item, said metal surface treated by an ion beam treatment, the rubber adhered to said treated metal surface.

2. A metal item according to claim 1, wherein said ion beam treatment is a sputter deposition of metal.

3. A metal item according to claim 2, wherein said treatment is said ion beam deposition of a coating metal, wherein said coating metal is selected from the group consisting of copper, steel, zinc, nickel, aluminum, cobalt, iron, and alloys thereof including brass, and wherein the thickness of said coating metal ranges from about 5 to about 4,000 angstrom units.

4. A metal item according to claim 3, wherein said rubber is selected from the group consisting of dienes having from 4 to 12 carbon atoms, and interpolymers thereof, interpolymers made from dienes having from 4 to 12 carbon atoms and vinyl substituted aromatics having from 8 to 12 carbon atoms, nitrile rubber, polychloroprene, EPDM, and combinations thereof.

5. A metal item according to claim 1, wherein said metal surface is a substrate and has a metallic coating thereon, and wherein said ion beam treatment is a sputter etching of said metallic coating.

6. A metal item according to claim 4, wherein said ion is selecting from the group consisting of a tire cord a tire bead, and wherein said coating is copper.

7. A metal item according to claim 5, wherein said metal surface coating is selected from the group consisting of copper, steel, zinc, iron, nickel, aluminum, cobalt, and alloys thereof including brass, and wherein the thickness of said coating ranges from about 5 to about 4,000 angstrom units.

8. A metal item according to claim 7, wherein said rubber is selected from the group consisting of dienes having from 4 to 12 carbon atoms, and interpolymers thereof, interpolymers made from dienes having from 4 to 12 carbon atoms and vinyl substituted aromatics having from 8 to 12 carbon atoms, nitrile rubber, polychloroprene, EPDM, and combinations thereof.

9. A metal item according to claim 8 wherein said item is selected from the group consisting of a tire cord, a tire bead, and wherein said coating is copper.

10. A metal item according to claim 6, wherein said coating thickness is from about 500 to about 1000 angstrom units and wherein said rubber is selected from the group consisting of natural or synthetic cis-1,4-polyisoprene, polybutadiene, or styrene-butadiene rubber.

11. A metal item according to claim 9, wherein said coating thickness is from about 500 to about 1000 angstrom units and wherein said rubber is selected from the group consisting of natural or synthetic cis-1,4-polyisoprene, polybutadiene, or styrene-butadiene rubber.

* * * * *